US006450836B1

(12) United States Patent
Youtsey

(10) Patent No.: US 6,450,836 B1
(45) Date of Patent: Sep. 17, 2002

(54) TRANSIENT SUPPRESSION F-CONNECTOR

(75) Inventor: Timothy L. Youtsey, Mesa, AZ (US)

(73) Assignee: Phoenix Communication Technology, Gilbert, AZ (US)

( * ) Notice: Subject to any disclaimer, the term of this patent is extended or adjusted under 35 U.S.C. 154(b) by 0 days.

(21) Appl. No.: 09/855,076

(22) Filed: May 14, 2001

(51) Int. Cl.[7] ..... H01R 13/66
(52) U.S. Cl. ..... 439/620; 361/119
(58) Field of Search ..... 439/620, 57 E; 361/799, 119; 174/51

(56) References Cited

U.S. PATENT DOCUMENTS

| | | | | |
|---|---|---|---|---|
| 3,274,447 | A | 9/1966 | Nelson | |
| 3,863,111 | A | 1/1975 | Martzloff | |
| 4,509,090 | A | 4/1985 | Kawanami | |
| 4,633,359 | A | * 12/1986 | Mickelson et al. | 361/119 |
| 5,198,958 | A | 3/1993 | Krantz | |
| 5,237,293 | A | 8/1993 | Kan | |
| 5,724,220 | A | 3/1998 | Chaudhry | |
| 5,953,195 | A | 9/1999 | Pagliuca | |
| 5,991,136 | A | * 11/1999 | Kaczmarek et al. | 361/93.8 |
| 6,071,144 | A | 6/2000 | Tang | |
| 6,249,415 | B1 | * 6/2001 | Daoud et al. | 361/117 |

* cited by examiner

*Primary Examiner*—Gary F. Paumen
*Assistant Examiner*—James R. Harvey
(74) *Attorney, Agent, or Firm*—LaValle D. Ptak

(57) ABSTRACT

A spark transfer seizure or transient suppression component is designed into the female connector or F-connector employed to connect a coaxial cable to electrical components within a cable splitter or other similar circuit for various types of cable distribution systems. The F-connector itself is of a generally standard configuration, with the exception of a conductive metal projection extending outwardly at approximately 90° to its longitudinal axis. This projection extends through an aperture in the F-connector housing to the outer surface, or slightly beyond the outer surface, of the housing. The amount by which the projection extends beyond the outer surface of the housing is selected to be less than the air space between the outer surface of the housing and the metal wall of the receptacle for the F-connector housing. The actual distance is chosen to be sufficient to allow a spark transfer or voltage jump for voltage surges, which may appear on the F-connector through the coaxial cable connected to it, to prevent damaging voltage surges from being supplied through the F-connector to circuitry inside the cable splitter box.

14 Claims, 6 Drawing Sheets

TRANSIENT SUPPRESSION F-CONNECTOR

BACKGROUND

Female connectors or F-connectors are widely used in conjunction with cable television systems. Such connectors typically have an outer non-conductive housing for an electrically conductive connector in the form of a spring clip pin having contact fingers adjacent a hole in the end of the housing for receiving the end of the center conductor of a coaxial cable. passed through a hole in the housing. The opposite end of the spring clip is extended through the other end of the housing for connection to components located in a metal housing for a cable splitter or other components.

The United States patent to Tang U.S. Pat. No. 6,071,144 is directed to a hermetically sealed F-connector which employs the basic connector configurations of a clip pin conductor mounted within the connector body. The clip pin makes an electrical connection with the end of a central conductor of a coaxial cable extended through the top of the body to make contact with spring clip fingers. The opposite end of the clip pin is an extension passing through the bottom end of the housing for connection with components located inside the housing for a coaxial cable splitter, or other similar device. In the device shown in the Tang patent, the non-conductive caps surrounding the spring clip connector are placed inside a brass housing, when then is connected to the cable splitter box by means of external threads on the brass housing. There is nothing in the Tang patent, however, directed to the problem of conveying voltage surges through the connector, from the coaxial cable to components located within the housing with which the connector is used.

A problem, however, exists in conjunction with cable television systems, or similar systems, with respect to electrical surges which may take place in the incoming coaxial cable. If such a surge hits the circuitry inside the cable splitter box (or similar circuit), it is possible to damage the circuit and cause failures. Often, these failures are catastrophic. Consequently, if no surge protection device is used in conjunction with the F-connector of the type shown in the Tang patent, the surges are conducted directly through the connector to the sensitive components.

The United States patent to Martzloff U.S. Pat. No. 3,863,111 discloses the use of a polycrystalline varistor surge protector device for VHF signal lines. The device of this patent employs a connector with a housing attached to it containing the polycrystalline varistor and a conductive spring. The spring is configured to provide proper mechanical positioning of the varistor, and to provide an electrical inductance in series with the varistor to prevent capacitive loading of the protected signal line. Signals exceeding a predetermined voltage are shunted through the varistor to the housing.

The United States patents to Kawanami U.S. Pat. No. 4,509,090; Chaudhry U.S. Pat. No. 5,724,220; and Pagliuca U.S. Pat. No. 5,953,195 all are directed to relatively expensive and somewhat complex gas discharge tubes interconnected in various ways into a circuit for providing surge protection, or operating as lightning arresting structures. As is readily apparent from an examination of the disclosures of these patents, the gas discharge tubes which are employed for the surge protection function necessarily must be added elements to the circuits with which they are used.

The United States patent to Nelson U.S. Pat. No. 3,274,447 is directed to a coaxial cable lightning arrester structure. In the device of Nelson, a "T" is made as a connection to the coaxial line, with a projection from the T extended toward an adjustable prong which establishes the width of a spark gap. The adjustable prong, in turn, is mounted in a metal housing which is grounded. Thus, in the event a surge takes place in the coaxial cable with which the device is used, a spark extends from the coaxial "T" to the adjustable pointer and is dissipated. A problem with this device, however, is that it necessarily involves an additional structure which must be built into or connected to a coaxial line by means of appropriate couplers; so that additional components, resulting in added bulk and expense, are necessary in order to utilize the surge protection feature of the patent.

Accordingly, it is desirable to provide a surge protection or spark arrest for utilization in conjunction with an F-connector for a coaxial cable, which is inexpensive, simple to install and use, and which does not require a modification of other components in the system with which it is used.

SUMMARY OF THE INVENTION

It is an object of this invention to provide an improved coaxial cable F-connector.

It is another object of this invention to provide an improved coaxial cable F-connector with a surge protection feature.

It is an additional object of this invention to provide an improved coaxial cable F-connector with an integral surge protection component.

It is a further object of this invention to provide an improved F-connector for a coaxial cable including an integral surge protection or spark transfer extension integrally formed with the other components of the F-connector.

In accordance with a preferred embodiment of the invention, a female connector or F-connector for a coaxial cable is housed in a main housing member made of electrical insulating material. The main housing member has a top, with a centrally located hole forming an input port for the center conductor of a coaxial cable. The housing has an open bottom. A cap made of electrically insulating material also has an open end and a closed end; and a centrally located slot is formed in the closed end. The main housing member and the cap have interrelated parts, which are used to secure the open end of the cap to the open end of the main housing member to hold an electrically conductive spring clip pin located substantially along the central axis of the main housing member and the cap. The spring clip pin has opposing spring-biased contact fingers located for receiving the end of the center conductor of a coaxial cable passed through the hole in the top of the main housing member. The pin also has a contact extension, which passes through the slot in the cap, for providing electrical contact to the spring clip pin. The spring clip pin further has a conductive projection oriented at substantially 90° to the central axis of the main housing member and the cap (and, therefore, of the spring clip pin). This conductive projection extends through an aperture in one of the main housing member or the cap to terminate at, or slightly beyond, the external surface of the main housing member or cap for forming a spark gap with the metal housing, into which the F-connector assembly is located.

DETAILED DESCRIPTION

Figure 1:
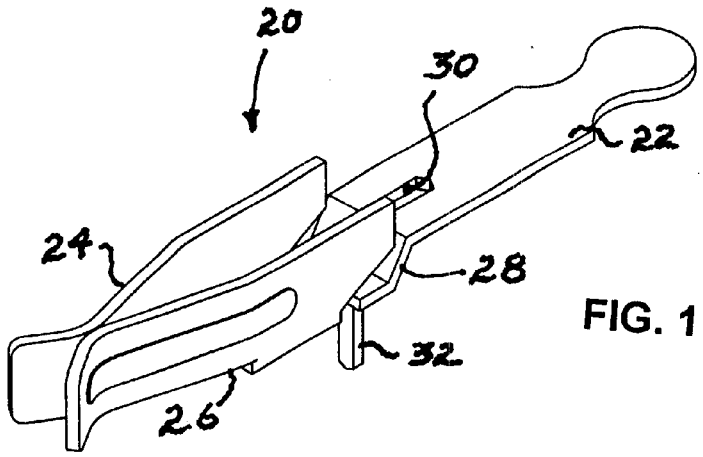
FIG. 1 is a top perspective view of a spring clip pin of an F-connector according to a preferred embodiment of the invention.
Figure 2:
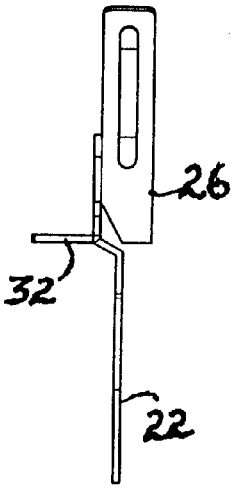
FIGS. 2, 3, 4, 5 and 6 are respective right-side, bottom, left-side, top and bottom views of the spring clip pin of FIG. 1.
Figure 3:
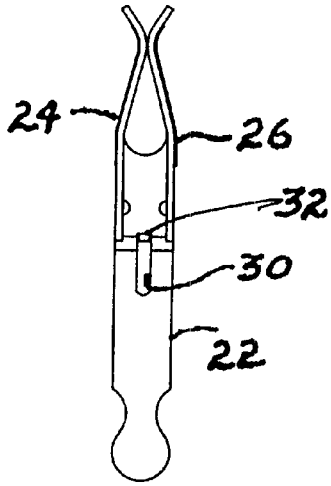
Figure 4:
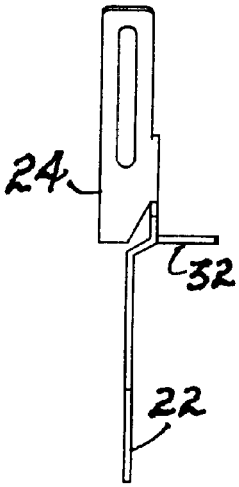
Figure 5:
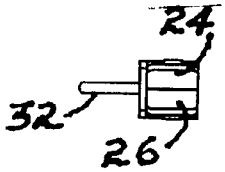
Figure 6:
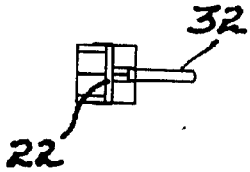

Reference now should be made to the drawings, in which the same reference numbers are used throughout the different figures to designate the same or similar components. FIG. 1 is a perspective view of a preferred embodiment of a spring clip pin 20 made of conductive material, such as spring steel, brass or the like, and forming the electrically conductive portion of a female connector or F-connector for interconnecting a coaxial cable to other components, such as a cable splitter or the like. FIGS. 2, 3, 4, 5 and 6 are additional views showing all of the features of the spring clip pin 20 of FIG. 1, and the relative orientation of the various parts. The spring clip pin 20 comprises a contact extension portion 22, which, as described subsequently, is used to form a connection terminal for interconnecting circuitry in a variety of components, including a cable splitter, to the spring clip pin. At the upper end, or opposite end, of the spring clip pin 20 are a pair of inwardly-turned spring contact fingers 24 and 26 which are biased together to contact one another a short distance from their outwardly turned ends, as seen most clearly in FIGS. 1 and 3. A transverse step or shoulder 28 interconnects the extension 22 with the fingers 24 and 26; and a conductive projection 32 extends substantially at right angles to the longitudinal axis passing through the spring fingers 24 and along the length of the extension 22, as shown most clearly in FIGS. 2, 4, 5 and 6. The projection 32 is punched from or otherwise formed from the same piece of material used to form all of the other parts of the spring clip pin 20. The slot 30 shown in FIGS. 1 and 3 remains after the projection 32 is formed from the original blank, and it is bent outwardly at 90°, as shown most clearly in FIGS. 2 and 4.

Figure 7:
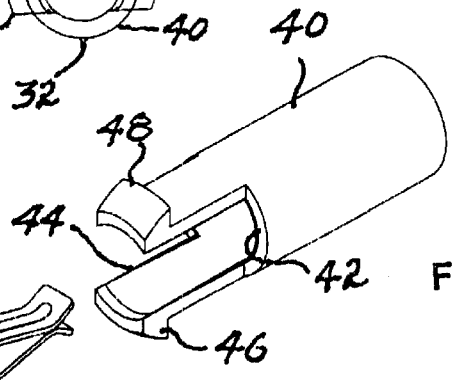
FIG. 7 is an exploded view of the completed F-connector and housing of a preferred embodiment of the invention.
Figure 15:
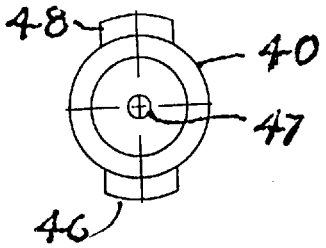
FIG. 15 is a top view of the component shown in FIG. 13.
Figure 16:
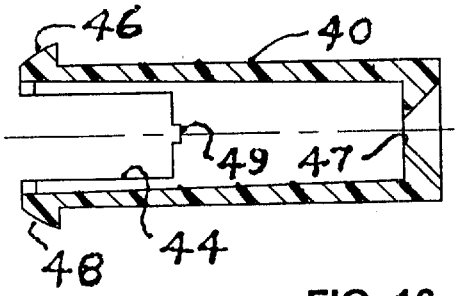
FIG. 16 is a cross-sectional view of the component shown in FIG. 13.
Figure 17:
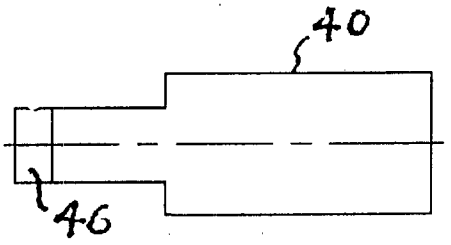
FIG. 17 is a side view of the component rotated 90° from the view of FIG. 16.
Figure 18:
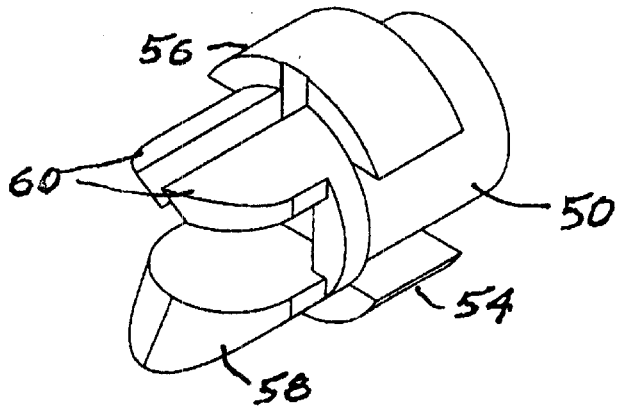
FIG. 18 is a perspective view of a portion of the assembly shown in FIG. 7.
Figure 19:
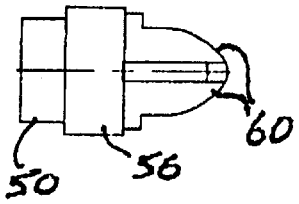
FIG. 19 is a right-side view of the component shown in FIG. 18.
Figure 20:
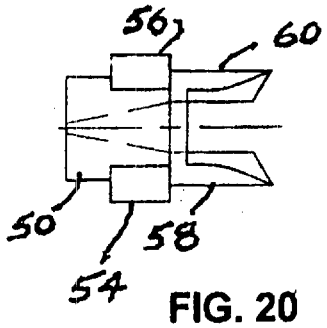
FIG. 20 is a side view rotated 90° from the view in FIG. 19.
Figure 21:
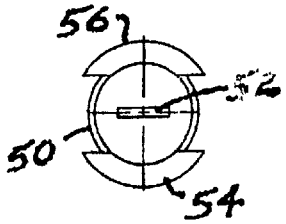
FIG. 21 is a bottom view of the component shown in FIG. 18.
Figure 22:
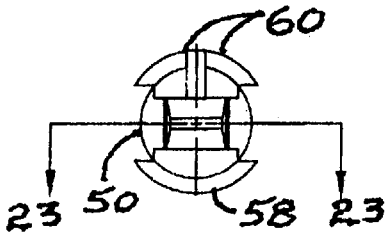
FIG. 22 is a top view of the component shown in FIG. 18.
Figure 23:
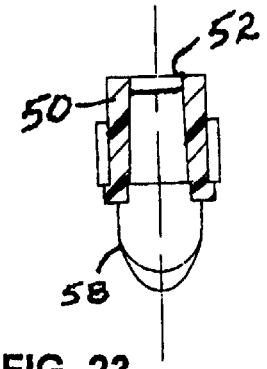
FIG. 23 is a cross-sectional view of the component shown in FIG. 18.

FIGS. 7 through 12 represent various views of the completed assembly of the F-connector, which includes the conductive portion in the form of the spring clip pin 20. FIG. 7 is an exploded view showing the orientation of the various parts, including a main housing member 40 and a cap 50, which are used to contain and hold the spring clip pin 20 in place, as illustrated most clearly in the cross-sectional views of FIGS. 24 and 25. The main housing member 40 is a hollow cylindrical member made of non-conductive material closed at its upper end, with a circular hole 47 located in the center of the upper end, as shown most clearly in FIGS. 10 and 15. The opposite end (the left-hand end as viewed in FIG. 7) of the member 40 is open and includes a pair of diametrically opposed slots 42 and 44. These slots are dimensioned to accommodate a pair of shoulders 54 and 56, respectively, on a cylindrical cap 50, which has a pair of extending fingers 58 and 60 extending toward the slots 42 and 44, respectively, for engaging the interior of the member 40 below the slots 42 and 44 to securely hold the cap in place on the member 40 in the orientation shown most clearly in FIG. 8.

Figure 12:
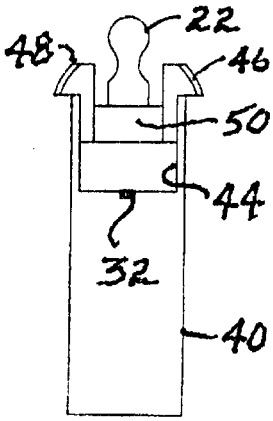
FIG. 12 is a different side view, rotated 90° from the one of FIG. 11, of the assembly shown in FIG. 8.
Figure 10:
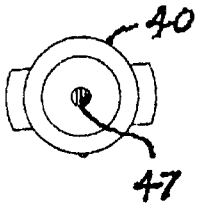
FIG. 10 is a top view of the housing of FIG. 7.
Figure 13:
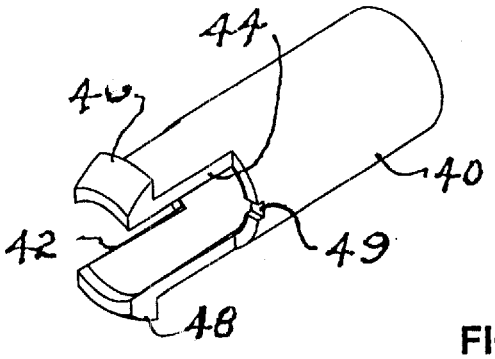
FIG. 13 is a perspective view of a portion of the assembly shown in FIGS. 8 through 12.
Figure 14:
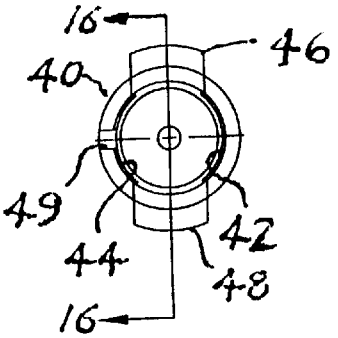
FIG. 14 is a bottom view of the component shown in FIG. 13.

FIG. 13 is a perspective view of the member 40 rotated 180° from the view shown in FIG. 7 to show a small notch 49 at the bottom of the slot 44. The finger (?) 60 on the cap 50 is bifurcated along its entire length, with the width of the space between the bifurcations of the finger 60 being equal to, or substantially equal to, the width of the notch 49 and aligned with the notch 49. Consequently, when the device is assembled by collapsing the parts of FIG. 7 together into the structure shown in FIGS. 8 through 12, the conductive projection 32 on the spring clip pin 20 extends through the notch or space between the bifurcated sections of the finger 60 and rests in and extends from the notch 49 in the main housing member 40. This is illustrated in various ones of the figures, such as FIGS. 8, 11, 12, 24 and 25. Particularly with reference to FIGS. 24 and 25, it is seen that the projection 32 extends just slightly beyond the outer diameter of the main housing member 40 and the cap 50, where they contact one another. The end of the conductive projection 32 is exposed to the ambient region immediately adjacent the diameter of the parts 40 and 50 when the F-clip is fully assembled, as shown in FIGS. 8 through 12, 24 and 25.

The details of the various parts of the main housing 40 are shown extensively in FIGS. 13 through 17, and of the cap 50 in FIGS. 18 through 23. Particularly with reference to FIGS. 18, 19 and 22, the slot between the bifurcations of the finger 60 is clearly shown. Also as is readily apparent from the cross-sectional views of FIGS. 23, 24 and 25, the end of the cap 50, which is closed (and which may be referred to as its top), has an elongated slot 52 in it for allowing passage of the extension 22 through the slot 52. The slot 52 has a rectangular configuration dimensioned to be slightly greater than the rectangular cross section of the extension 22 on the spring clip pin 20 to hold and orient the spring clip pin 20 in an aligned position within the housing formed by the interconnections of the cap 50 with the housing member 40. It should be noted that when the cap 50 is inserted into position within the housing member 40, the projections 54 and 56 are seated in the bottoms of the slots 42 and 44, as shown most clearly in FIGS. 8, 11, 12, 24 and 25.

Figure 24:
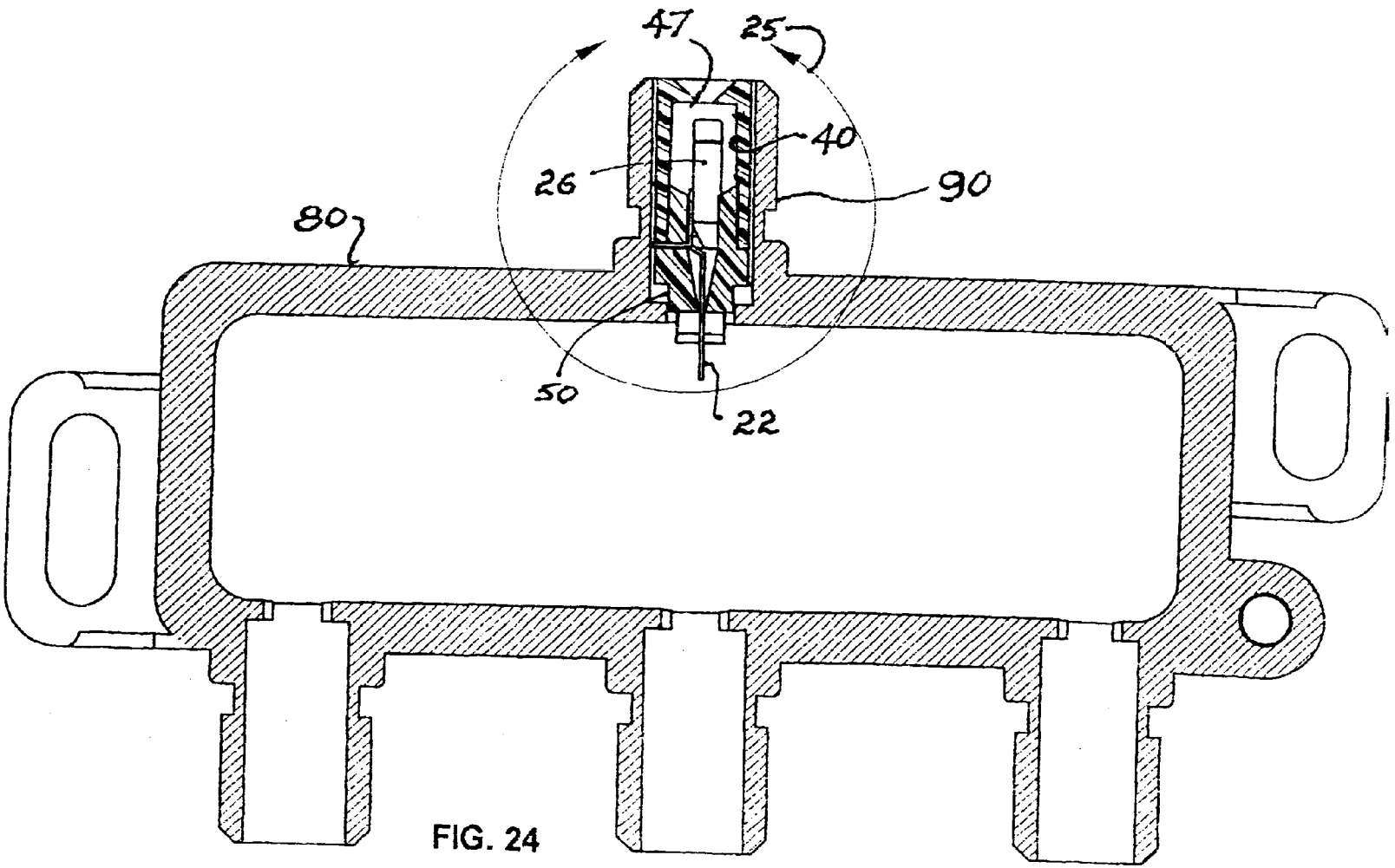
FIG. 24 is a cross-sectional view of the housing assembly of FIG. 8 showing its location of use with the housing for a cable splitter.
Figure 25:
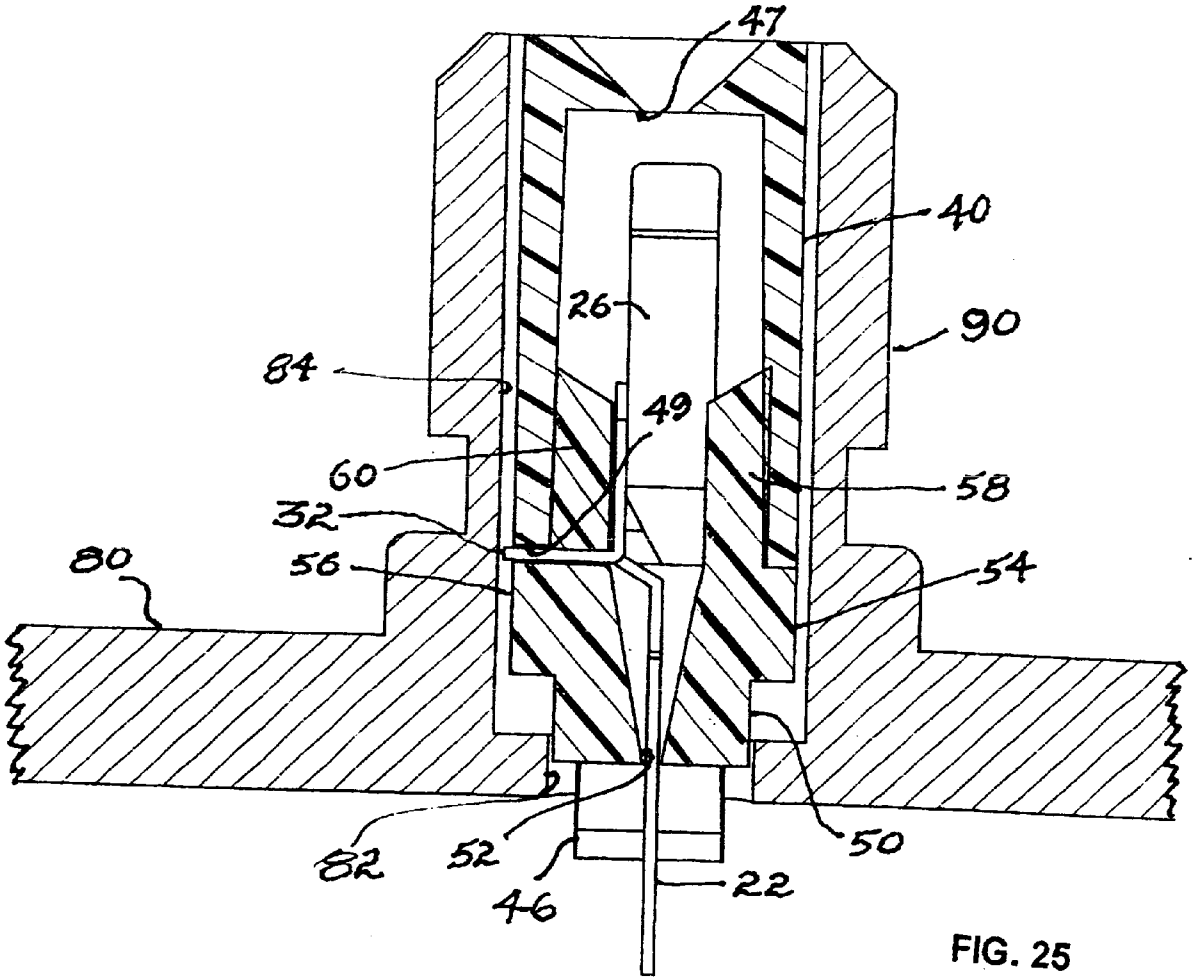
FIG. 25 is an enlarged detailed cross-sectional view of a portion circled as 25 is FIG. 24.

The spring clip pin 20 also is held in place against longitudinal movement by the projection 32 into the slot 49 and held in place on opposite sides by the ear or projection 56, again, as shown most clearly in FIGS. 24 and 25. The internal dimensions of the fingers 58 and 60 are such that they contact the edges of the spring fingers 24 and 26 of the clip 20, as shown-most clearly in FIGS. 24 and 25; so that the spring clip 20 is firmly held in place in a centered location within the main housing member 40 and the cap 50, as illustrated in FIGS. 24 and 25.

Figure 8:
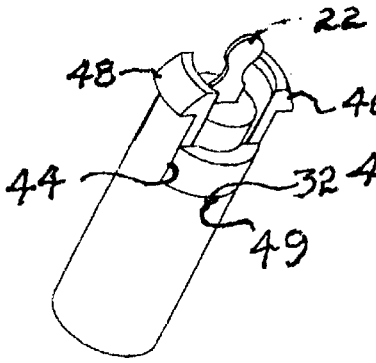
FIG. 8 is a perspective view of the bottom of the housing assembly shown in FIG. 7.
Figure 9:
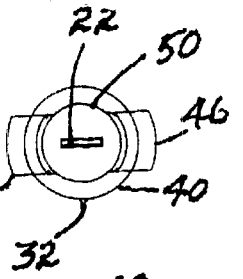
FIG. 9 is a bottom view of the housing of FIG. 7.

When the device illustrated in the various assembled and component parts of FIGS. 1 through 23 is to be used, the completed assembly, as shown in FIG. 8, is inserted into a metal barrel extension or entry port 90 of a metal housing such as a housing 80 for a cable splitter. This is illustrated in cross section in FIG. 24 and in partial cross section in FIG. 25. The housing 80 is a representative housing, with a single input entry port 90, and any desired number of exit ports (three of which are shown in FIG. 24) of exit ports. The circuitry which is located inside the housing 80 and the interconnections to the various exit ports are conventional and are not important to an understanding of the invention.

The entry port 90, however, typically is formed as an integral part of the metal housing 80, which in turn is grounded in any suitable conventional manner. When the cap 50 is fully inserted into the body of the main housing member 40, as shown in FIG. 8, the main housing member has a pair of shoulders 46 and 48 which extend outwardly from it, and which are used to align the device and secure it into the port 90 by extending over the internal wall of the housing 80 to prevent the F-connector assembly from being pulled out of the port 90 once it has been installed. This orientation of these parts is shown most clearly in FIG. 25.

Figure 11:
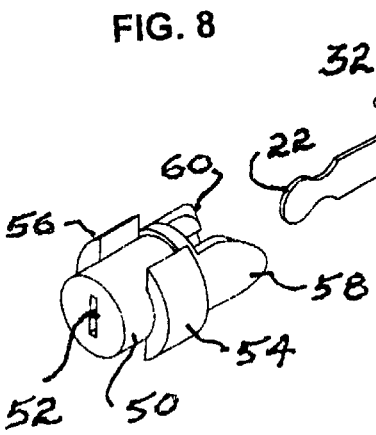
FIG. 11 is a side view of the assembly shown in FIG. 8.
Figure 11:
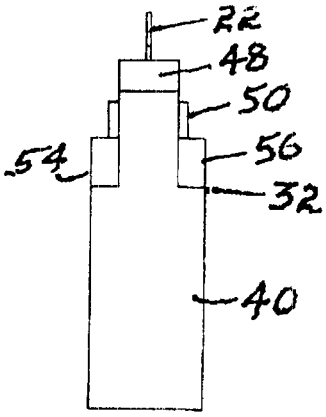

Once the F-connector has been inserted in the entry port 90 as illustrated in the cross-sectional views of FIGS. 24 and 25, it is firmly held in place in a centered location, with a small air space 84 located between the internal wall of the port 90 and the external diameter or surface of the member 40 and the cap 50 when they are in their assembled orientation, as shown in FIGS. 8, 11 and 12. As is most clearly shown in FIG. 25, the metal projection 32, which is conductively connected to the remainder of the spring clip pin 20 (being integrally formed as a part of the entire assembly 20 as described previously) extends partially into the air space 84 between the housing member 40 and the interior surface of the metal port 90. The pin 32 does not extend all the way across the space 84; and no physical contact is made with the internal wall of the port 90, as is clearly illustrated in FIG. 25.

The distance between the end or the tip of the projection 32 and the interior wall of the port 90 is selected to allow a break-over spark when a voltage surge in excess of some pre-established amount occurs on a coaxial cable having its center conductor extended through the hole 47 and gripped by the fingers 24 and 26. Under normal conditions of operation, the projection 32 is an inert part of the entire assembly. It serves to assist in the orientation and holding of the spring clip pin 20 in place; but it does not serve any electrical function under normal operation of the system. If a voltage surge, such as caused by lightning or any other cause, occurs, however, the small air gap between the tip of the projection 32 and the interior wall of the port 90 is such-that a voltage discharge takes place through the tip of the projection 32 into the port 90, and from there into the housing 80. This harmlessly dissipates any excess voltage prior to that voltage reaching sensitive circuit components located within the housing 80.

The use of the simple conductive projection 32 connected to the spring clip pin 20 of the electrically conductive parts of the F-connector operates as an extremely simple and effective way of dissipating excess voltages or voltage surges prior to the application of those voltages to circuitry within the housing 80 connected to the extension 22 of the F-connector. No other circuit components are required. For any given situation, the dimensions of all of the various components which are shown in cross-sectional view in FIGS. 24 and 25 are selected to cause the break-over voltage between the tip of the projection 32 and the interior wall of the port 90 to be selected in accordance with the operating parameters of the system with which the F-connector is used. Once all of the dimensions of the various parts initially are established, no further adjustments are necessary in any of the parts. All of the parts interconnect and interrelate in a manner to firmly hold the spring clip pin 20 in place with the proper extension of the tip of the projection 32 for the desired voltage break-over being attained.

The foregoing description of the preferred embodiment of the invention is to be considered illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A female connector for a coaxial cable including in combination:

a main housing member made of electrically insulating material having a top with a centrally located hole in the top forming an input port, and the main housing member having an open bottom;

a cap made of electrically insulating material having an open end and a closed end, with a centrally located slot in the closed end, with means for securing the open end of the cap to the open end of the main housing member and to align the slot in the cap with the hole in the housing member on a longitudinal axis that extends through the housing member and the cap;

an electrically conductive spring clip pin having first and second opposing contact fingers that are spring-biased into contact with one another and located adjacent the hole in the main housing member for receiving the end of a center conductor of a coaxial cable that is passed through the hole in the top of the main housing member, the spring clip pin having a contact extension electrically coupled with at least one of the first and second opposing contact fingers, the contact extension passing through the slot in the cap, the spring clip pin further having an electrically conductive projection electrically coupled with the contact fingers and the contact extension and with the electrically conductive projection being oriented at substantially 90° to the longitudinal axis that extends through the housing member and the cap, and the electrically conductive portion extending through an aperture in one of either the main housing member or the cap to terminate at substantially the external surface thereof.

2. The female connector according to claim 1 wherein the main housing member and the cap have cooperating portions to form the aperture through which the projection on the spring clip pin extends.

3. The female connector according to claim 2 wherein the projection on the spring clip pin extends beyond the external surface of the main housing member.

4. The female connector according to claim 3 wherein the cap and the main housing member are designed with external dimensions to fit within and be spaced from the internal wall of a metal port on a housing containing circuitry to which the contact extension is to be connected.

5. The female connector according to claim 4 wherein the spring clip pin comprising the first and second contact fingers, the contact extension, and the projection all are formed of a unitary metal member.

6. The female connector according to claim 5 wherein the main housing member is a hollow cylindrically shaped member with an internal diameter and an external diameter, and the cap is a substantially hollow cylindrical member with resilient fingers thereon for releasably engaging the cap with the main housing member wherein the slot in the cap and the hole in the main housing member are located on a common longitudinal axis through the main housing member and the cap when the cap is assembled onto the main housing member.

7. A female connector according to claim 6 wherein the projection on the spring clip pin extends outwardly from the outer surface of the main housing member and the cap a distance which is less than the space between the outer surface of the main housing member and the cap and the internal surface of the metal port in which the female connector is mounted for transferring voltage surges through the projection to the metal port across the space between the projection and the internal wall of the metal port adjacent the projection.

8. The female connector according to claim 1 wherein the cap and the main housing member are designed with external dimensions to fit within and be spaced from the internal wall of a metal port on a housing containing circuitry to which the contact extension is to be connected.

9. A female connector according to claim 8 wherein the projection on the spring clip pin extends outwardly from the outer surface of the main housing member and the cap a distance which is less than the space between the outer surface of the main housing member and the cap and the internal surface of the metal port in which the female connector is mounted for transferring voltage surges through the projection to the metal port across the space between the projection and the internal wall of the metal port adjacent the projection.

10. The female connector according to claim 1 wherein the spring clip pin comprising the first and second contact fingers, the contact extension, and the projection all are formed of a unitary metal member.

11. The female connector according to claim 10 wherein the main housing member and the cap have cooperating portions to form the aperture through which the projection on the spring clip pin extends.

12. The female connector according to claim 11 wherein the projection on the spring clip pin extends beyond the external surface of the main housing member.

13. The female connector according to claim 1 wherein the main housing member is a hollow cylindrically shaped member with an internal diameter and an external diameter, and the cap is a substantially hollow cylindrical member with resilient fingers thereon for releasably engaging the cap with the main housing member wherein the slot in the cap and the hole in the main housing member are located on a common longitudinal axis through the main housing member and the cap when the cap is assembled onto the main housing member.

14. The female connector according to claim 1 wherein the projection on the spring clip pin extends beyond the external surface of the main housing member.

* * * * *